US009702667B1

(12) United States Patent
Gutierrez

(10) Patent No.: US 9,702,667 B1
(45) Date of Patent: Jul. 11, 2017

(54) GUN TARGET SYSTEM

(71) Applicant: Timothy J. Gutierrez, Haslet, TX (US)

(72) Inventor: Timothy J. Gutierrez, Haslet, TX (US)

( * ) Notice: Subject to any disclaimer, the term of this patent is extended or adjusted under 35 U.S.C. 154(b) by 0 days.

(21) Appl. No.: 15/178,658

(22) Filed: Jun. 10, 2016

Related U.S. Application Data

(60) Provisional application No. 62/174,398, filed on Jun. 11, 2015.

(51) Int. Cl.

| | |
|---|---|
| ***F41J 9/02*** | (2006.01) |
| ***F41J 1/10*** | (2006.01) |
| *F41J 9/00* | (2006.01) |
| *A63B 63/06* | (2006.01) |

(52) U.S. Cl.
CPC . *F41J 9/02* (2013.01); *F41J 1/10* (2013.01); *A63B 63/06* (2013.01); *F41J 9/00* (2013.01)

(58) Field of Classification Search
CPC ..... F41J 7/00; F41J 7/04; F41J 9/00; F41J 3/0023; A63B 63/06
USPC ..... 273/390–392, 403–410
See application file for complete search history.

(56) References Cited

U.S. PATENT DOCUMENTS 626,500 A * 6/1899 McCullough ..... A63F 9/02 273/348
1,190,099 A * 7/1916 Brown ..... F41J 5/20 273/387
1,212,943 A * 1/1917 Hart ..... F41J 5/18 273/383
1,424,632 A * 8/1922 Fenton ..... F41J 7/04 273/392
1,488,647 A * 4/1924 Quinn ..... F41J 7/04 273/368
1,507,296 A * 9/1924 Newman ..... A63F 9/02 273/357
1,537,738 A * 5/1925 Bisbing ..... A63F 7/3622 273/390
2,232,743 A * 2/1941 Swenson ..... F41J 7/04 273/368
3,552,749 A * 1/1971 Piggotte ..... A63B 69/0071 273/368
3,814,429 A * 6/1974 Lienhard ..... A63B 63/06 273/127 D
4,042,242 A * 8/1977 Nicholls ..... F41J 9/02 185/31
4,093,227 A * 6/1978 Saunders ..... F41J 7/04 273/388
4,470,603 A * 9/1984 Myers ..... F41J 7/04 273/390
5,496,039 A * 3/1996 Zammuto ..... F41J 3/0023 273/368
7,134,977 B2 * 11/2006 Campbell ..... A63B 63/06 273/392

(Continued)

*Primary Examiner* — Mark Graham
(74) *Attorney, Agent, or Firm* — Eldredge Law Firm; Richard G. Eldredge

(57) ABSTRACT

A shooting target system includes a hub assembly a plurality of legs configured to removably engage with the plurality of leg fasteners of the housing; a plurality of arms configured to removably engage with the plurality of arm fasteners; a plurality of targets removably secured to the plurality of arms. The hub assembly includes a housing having a plurality of leg fastener joints; a shaft extending from the housing; and a hub rotatably secured to the shaft and having a plurality of arm fasteners.

14 Claims, 6 Drawing Sheets

(56) References Cited

U.S. PATENT DOCUMENTS

| | | | | |
|---|---|---|---|---|
| 7,611,147 | B2 * | 11/2009 | Sheldon | F41J 7/04 273/366 |
| 7,815,192 | B1 * | 10/2010 | Kreiman | F41J 7/04 273/390 |
| 9,228,809 | B1 * | 1/2016 | Relyea | F41J 9/02 |
| 2004/0214665 | A1 * | 10/2004 | Kane | A63B 63/083 473/433 |
| 2011/0074112 | A1 * | 3/2011 | Allen | F41J 1/10 273/407 |

* cited by examiner

GUN TARGET SYSTEM

BACKGROUND

1. Field of the Invention

The present invention relates generally to gun targets.

2. Description of Related Art

Gun targets are well known in the art and are effective means, for example, to train a shooter with gun safety and accuracy. The gun targets can also be used for recreational pleasure; shooters enjoy the experience of firing a gun at targets. In FIG. 1, a conventional gun target 101 is illustrated as having a target area 103, which in the exemplary embodiment, is a plurality of circles with various diameters. The target area is placed on a stationary board 105 and held above the ground via a support 107. During use, the shooter aims a gun (not shown) at the center of the target area 103 and attempts to shoot the projectile thereabout.

A common disadvantage associated with target 101 is the limited use and lack of long term joy in using stationary targets. For example, shooting at a stationary target may result in shooter losing interest and does not exercise the shooter's ability to train with moving targets.

Although great strides have been made in the area of gun targets, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
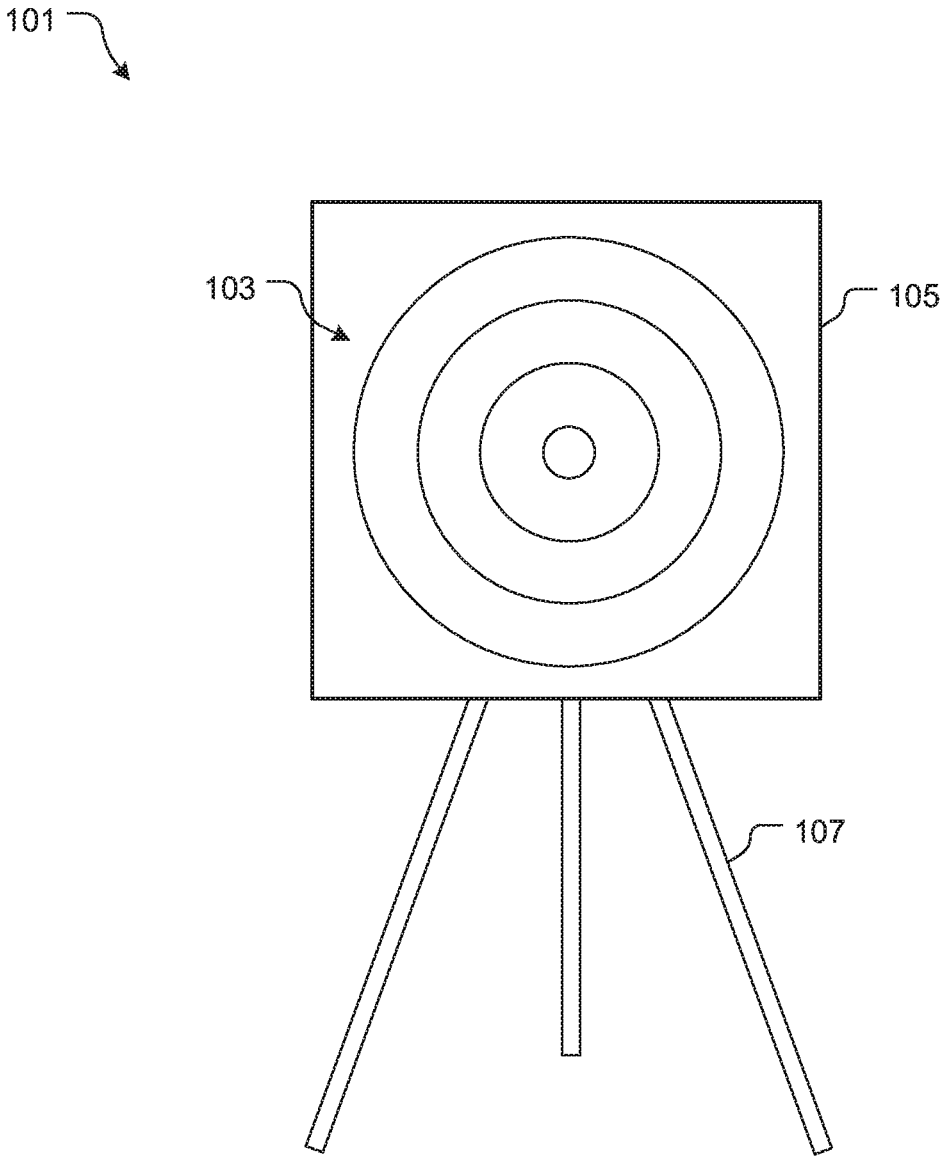
FIG. 1 is a front view of a conventional gun target.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional gun target systems. Specifically, the system of the present application is configured to provide rapid and effective means to transport the target to selective locations, and configured to provide rotational target movement, thereby increasing the training and enjoyment of shooting during use. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

Figure 2:
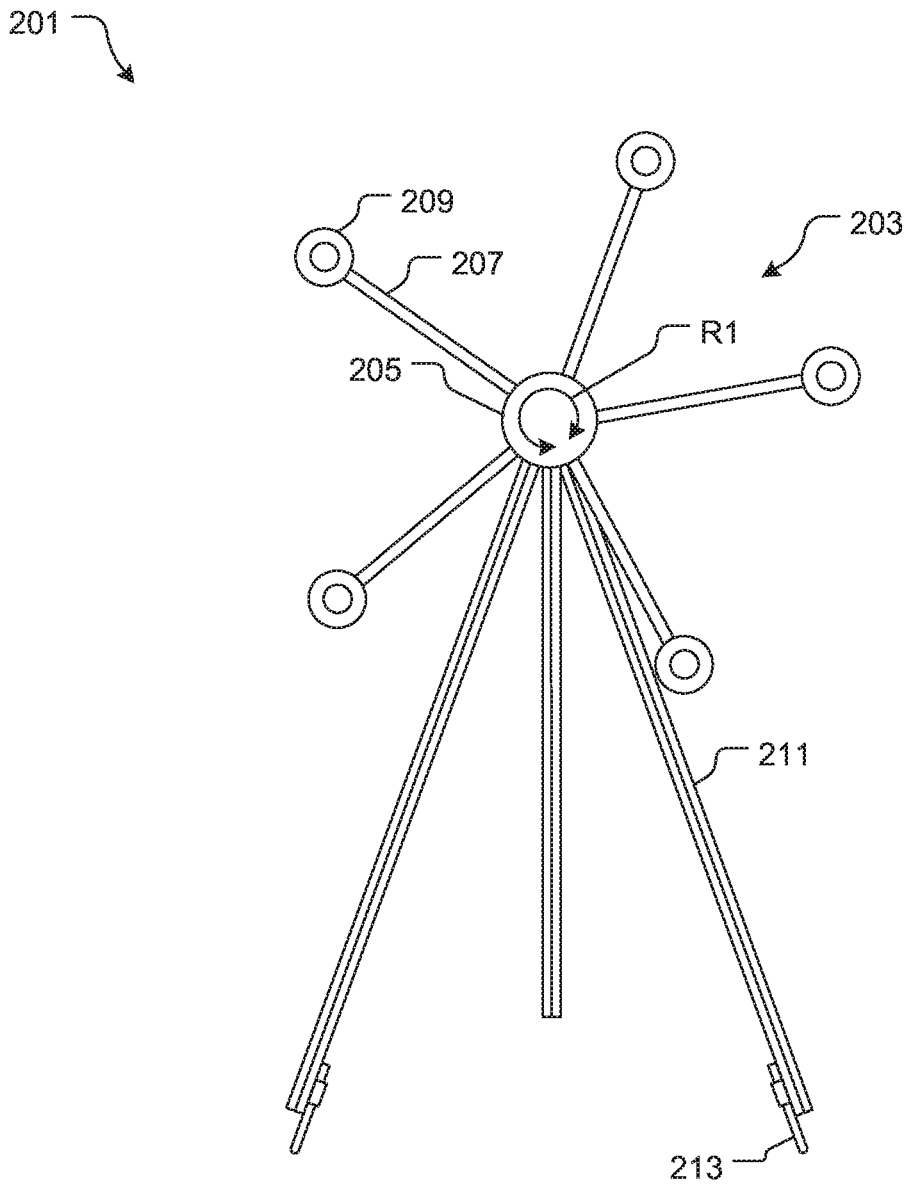
FIG. 2 is a front view of a gun target system in accordance with a preferred embodiment of the present application.

Referring now to the drawings wherein like reference characters identify corresponding or similar elements throughout the several views, FIG. 2 depicts a simplified front view of a gun target system 201 in accordance with a preferred embodiment of the present application. It will be appreciated that the system 201 overcomes one of more of the above-listed problems commonly associated with the conventional gun target systems.

In the contemplated embodiment, system 201 includes a hub assembly 203 having a hub 205 configured to rotate in direction R1, as indicated by an arrow. Attached to hub 205 are one or more arms 207 configured to secure a target 209 at a spaced distance from hub 205.

Hub assembly 203 is supported at an elevation relative to the ground (not shown) via a plurality of legs 211, which are optionally provided with stakes 213 configured to slidingly engage with leg 211.

Although shown with five arms 207 and three legs 211, alternative embodiments could include more of less arms and legs; depending on the design choice.

Figure 3:
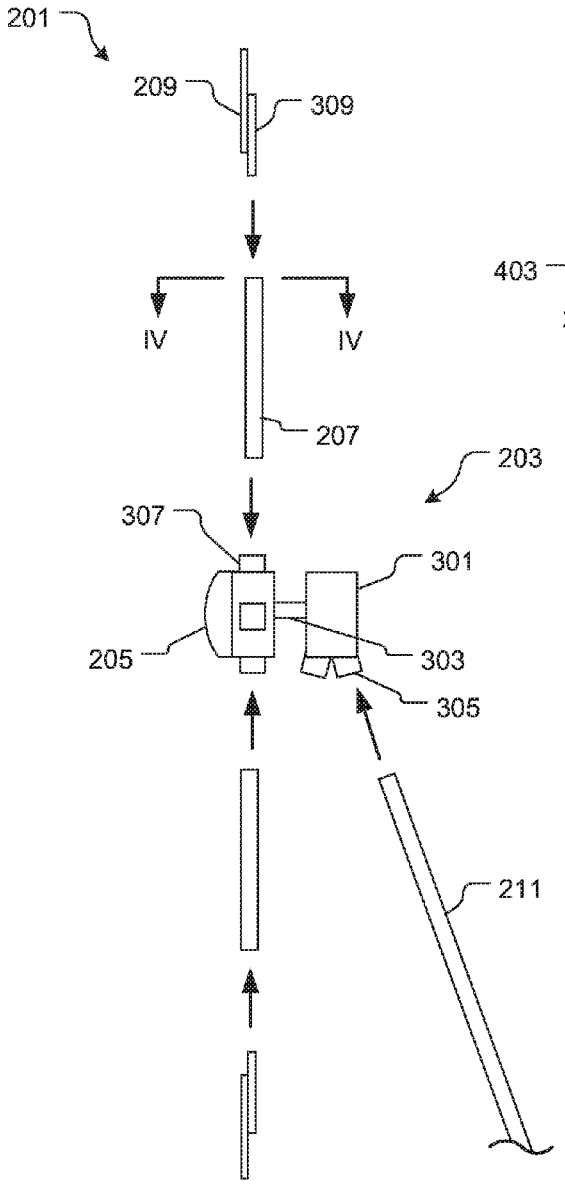
FIG. 3 is a side view of the target system of FIG. 2.

Referring to FIG. 3, a side view of system 201 is shown. Hub assembly 203 is provided with a housing 301 rotatably engaged with hub 205 via a shaft 303. Thus, during use, hub 205 rotates in direction R1 (see FIG. 2) relative to housing 301 via shaft 303.

Housing 301 is further provided with one or more leg fastening joints 305 configured to securely attach the legs 211 to housing 301. In the contemplated embodiment, three leg fastening joints are used to secure the three legs to the housing; however, alternative embodiments could include more or less leg fastening joints depending on the number of leg utilized. During assembly, legs 211 engage with joints 305 and securely fasten thereto via a fastening means. In one contemplated embodiment, joints 305 could be a housing that receives the legs therein and a fastener could be utilized to secure the legs to within the housing. In the preferred embodiment, the joints are quick-release devices such as magnets, clips, clamps, ball-hole fasteners, and so forth. In yet another embodiment, the joints could be secured via nut and bolt.

A plurality of arm fasteners 307 at carried by hub 205 and configured to securely fasten the arms 207 to hub 205. Like joints 305, the arm fasteners are substantially similar in form and function. Thus, the arms 207 are removably secured to the hub, thereby allowing easy and rapid assembly and disassembly.

One of the unique features believed characteristic of the present application is the feature of providing effective means via joints 305 and fasteners 307 to secure respective legs 211 and arms 207 the hub assembly. The disassembly feature allows system 201 to be portable.

Another unique feature believed characteristic of the present application is the feature of removably attaching target 209 to the arms 207. It should be understood that as the targets 209 are hit with a projectile, the targets disengage from arms 207. To achieve this feature, targets 209 includes an elongated member 309 that fixedly attached to target 209 and removably attached to arm 207.

In the contemplated embodiment, member 309 is composed of a metallic material that engages with a magnet carried on arm 207. The force of the projectile hitting the target causes the member to separate from the magnet. These features are illustrated more fully with respect to FIG. 6.

Figure 4:
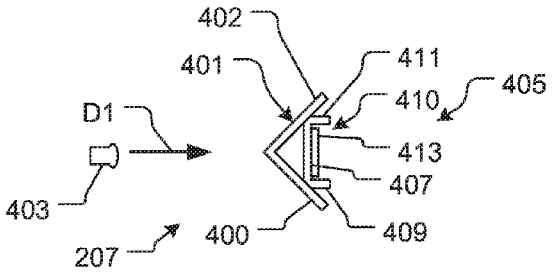
FIG. 4 is a front view of an arm of the target system of FIG. 3.

In FIG. 4, a front view of arm 207 is shown taken at IV-IV of FIG. 3. As depicted, arm 207 is manufactured with two members 400, 402 that come together at a 90 degree angle relative to each other. The two surfaces form a continuous surface 401 that deflects the projectile 403 upon contact, as depicted with arrow D1.

Securely attached to and opposing surface 401 is a channel 405 having a base 407 integral with two opposing sides 409, 411. The channel forms an area configured to receive the elongated rectangular member 309 therein. Thus, the sides 409, 411 prevent pivoting movement of the elongated member relative to base 407, which in turn adds additional support and rigidity during use.

In the contemplated embodiment, a magnet 411 is securely attached to base 407 and configured to secure elongated member 309 to channel 405. The combination of a strong magnet and the side surfaces of the channel provide effective means to secure the target to the arms.

Figure 5A:
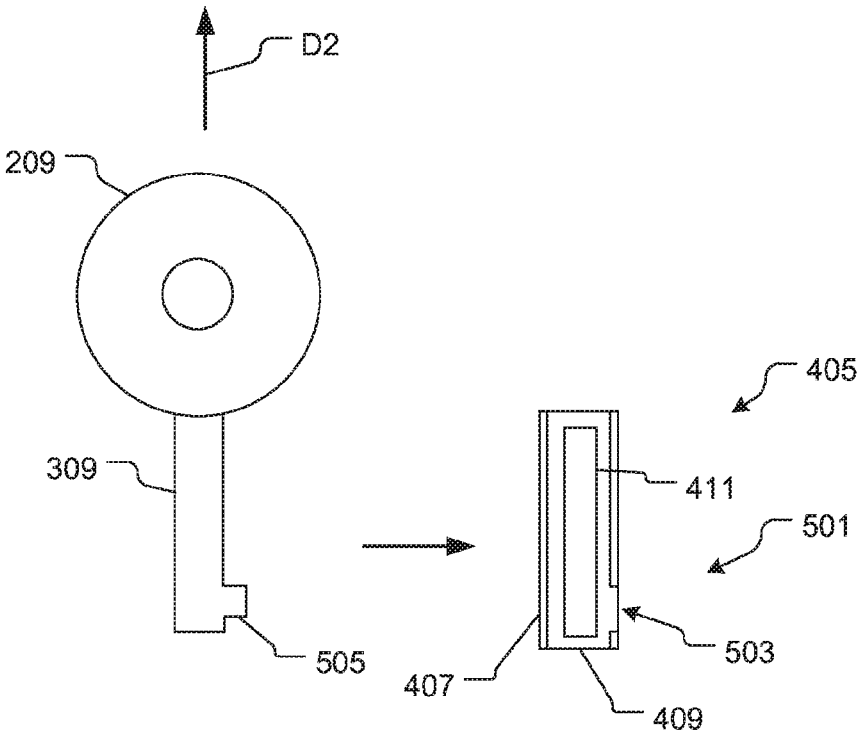
FIGS. 5A and 5B are front views of a target area of the target system of FIG. 2.
Figure 5B:
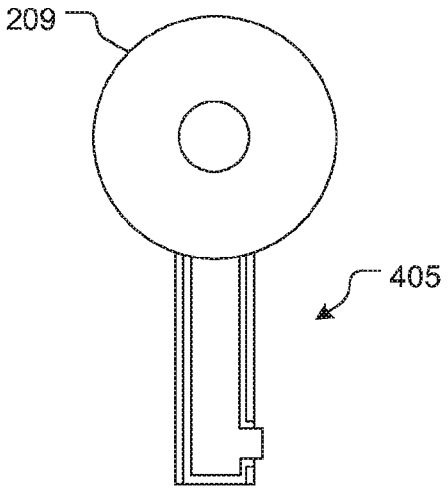

In FIGS. 5A and 5B, respective disassembled and assembled front views of the target and channel are depicted. It will appreciated that system 201 could also include a centrifugal stop 501 configured to prevent the elongated member 309 from sliding within channel 405 as the hub rotates and create centrifugal forces thereagainst, as depicted with arrow D2. To achieve this feature, it is contemplated using a slot 503 configured to receive a tab 505 extending from elongated member 309. During use, the tab 505 comes into contact with the side surface of the channel and is thereby prevented from slipping in direction D2 as centrifugal forces are applied thereagainst.

Figure 6:
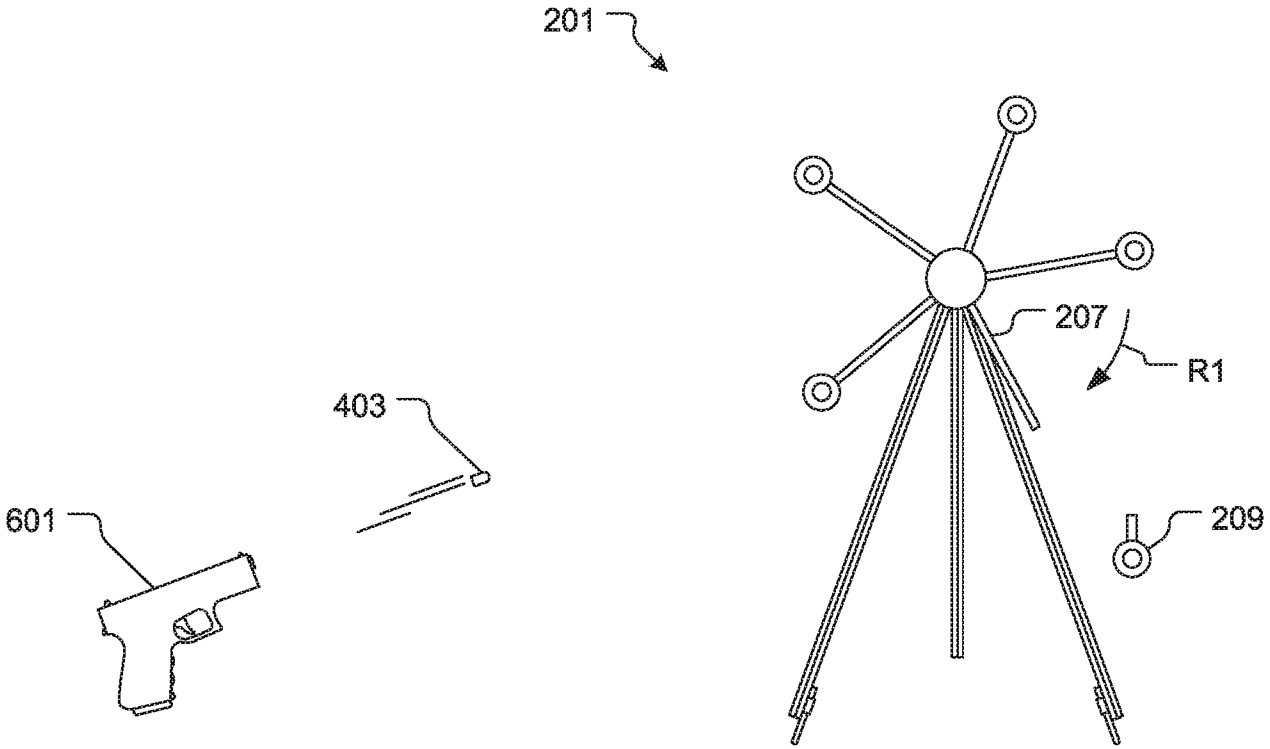
FIG. 6 is an oblique view of the target system of FIG. 2.

In FIG. 6, system 201 is shown during use. As depicted in the exemplary embodiment, the target 209 detaches from the arm 207 of system 201 as the projectile 403 from a gun 601 come into contact. The disengagement of target 209 causes an imbalance in weight distribution between the arms and targets, which in turn results in the hub assembly rotating in direction R1. This feature provides multiple moving targets for shooting.

Figure 7:
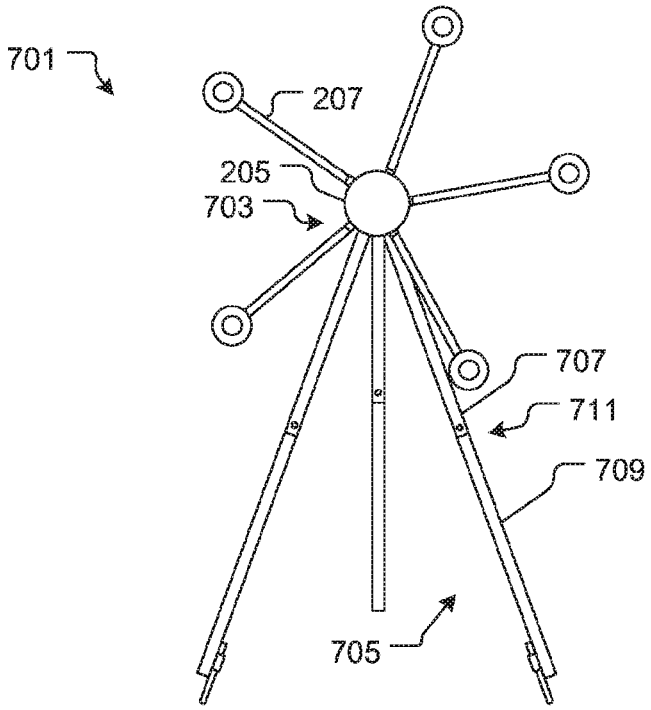
FIG. 7 is a front view of a gun target system in accordance with an alternative embodiment of the present application.
Figure 8:
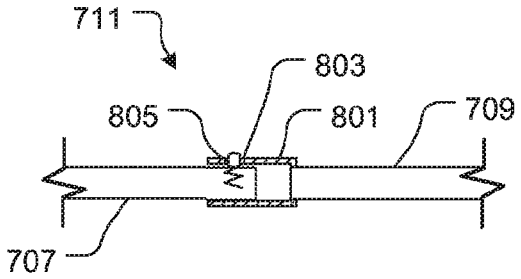
FIG. 8 is a front view of a leg of the system of FIG. 7.

Referring now to FIGS. 7 and 8 in the drawings, an alternative embodiment of system 201 is shown. It will be appreciated that system 701 is substantially similar in form and function to system 201 and incorporates one or more of the features discussed herein.

In the exemplary embodiment, system 701 includes arms 207 that removably attach to hub 205 via a quick-release device 703. This feature allows the user to quickly assemble and disassemble the arms during use and non-use.

Another unique feature is a leg 705 formed of two members 707 and 709 that are joined together via a quick-release device 711. This feature allows the user to break apart the legs during disassembly, which in turn facilitates easier carrying of the system during transportation.

In FIG. 8, it will be appreciated that both quick-release device 703, 711 are spring-loaded balls 805 members that fit within a hole 803 extending through a sleeve 801 rigidly attached to one of the two legs. During assembly, the user merely slides one of the legs within the sleeve and the ball engages with the hole to lock the legs in a fixed position.

Figure 9:
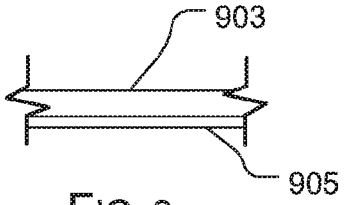
FIG. 9 is a partial front view of a magnet and shock absorber for a target in accordance with an alternative embodiment of the present application.

In FIG. 9, a partial front view of a magnet 903 and a shock absorber 905 for a target of a target system is shown in accordance with an alternative embodiment of the present application. It will be appreciated that one or more of the target systems discussed above could incorporate the features of the magnet 903 and shock absorber 905. In one contemplated embodiment, magnet 903 could be secured to the target and the shock absorber sandwiched there between. During use, the shock absorber 905 absorbs the impact energy hitting the target to reduce vibrations and damage to the system.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A shooting target system, comprising: a hub assembly, having:

a housing having a plurality of leg fastener joints; a shaft extending from the housing; and a hub rotatably secured to the shaft and having a plurality of arm fasteners;

a plurality of legs configured to removably engage with the plurality of leg fastener joints of the housing;

a plurality of arms configured to removably engage with the plurality of arm fasteners;

a plurality of targets removably secured to the plurality of arms;

a target of the plurality of targets having:

an elongated member configured to removably engage with an arm of the plurality of arms, the arm of the plurality of arms forming a channel with two elongated sides and a slot passing through a thickness of an elongated side of the two elongated sides;

wherein the elongated member of the target engages within the channel;

wherein the plurality of targets are configured to disengage with the plurality of arms upon impact of a projectile.

2. The system of claim 1, wherein the plurality of arms are equally spaced from each other.

3. The system of claim 1, wherein a leg of the plurality of legs comprises:

a first elongated member removably secured to a second elongated member; and a quick-release device configured to secure the first elongated member to the second elongated member.

4. The system of claim 3, the first elongated member comprising:

a sleeve extending at one end of a body of the first elongated member; and a hole extending through a thickness of the sleeve;

wherein the hole is configured to engage with a spring-loaded ball extending from an outer surface of the second elongated member;

wherein the spring-loaded ball is configured to secure the first elongated member to the second elongated member via the sleeve.

5. The system of claim 1, wherein the plurality of targets are circular in shape.

6. The system of claim 1, further comprising:

a magnet secured to the channel;

wherein the magnet is configured to removable secure the elongated member to the channel.

7. The system of claim 1, further comprising:

a tab extending from the elongated member;

wherein the tab is configured to engage with and extend through the slot of the elongated side.

8. The system of claim 7, further comprising:

a magnet secured to channel;

wherein the magnet is configured to removably secure the elongated member to the channel.

9. The system of claim 1, further comprising:

a plurality of adjustable stakes secured to the plurality of legs.

10. A target system, comprising:

a rotating hub assembly secured at a height relative to a ground surface via a plurality of legs;

a plurality of equally spaced arms extending from the rotating hub assembly;

a plurality of targets removably secured to the plurality of equally spaced arms; and a target of the plurality of targets having:

an elongated member configured to removably engage with an arm of the plurality of arms, the arm of the plurality of arms forming a channel with two elongated sides and a slot passing through a thickness of an elongated side of the two elongated sides:

wherein the elongated member of the target engages within the channel; and wherein the plurality of targets are configured to disengage with the plurality of arms upon impact of a projectile.

11. The target system of claim 10, the rotating hub assembly comprising:

a housing having a plurality of leg fastener joints;

a shaft extending from the housing; and a hub rotatably secured to the shaft and having a plurality of arm fasteners;

wherein the plurality of legs are configured to removably engage with the plurality of leg fastener joints of the housing;

wherein the plurality of arms are configured to removably engage with the plurality of arm fasteners.

12. The system of claim 10, further comprising: a magnet secured to the channel;

wherein the magnet is configured to removable secure the elongated member to the channel.

13. The system of claim 10, further comprising:

a tab extending from the elongated member;

wherein the tab is configured to engage with and extend through a slot of the elongated side.

14. The system of claim 13, further comprising: a magnet secured to channel;

wherein the magnet is configured to removably secure the elongated member to the channel.

* * * * *